US006224747B1

(12) United States Patent
Cash et al.

(10) Patent No.: US 6,224,747 B1
(45) Date of Patent: May 1, 2001

(54) HYDROCRACKING AND HYDROTREATING

(75) Inventors: Dennis R. Cash, Novato; Arthur J. Dahlberg, Benicia, both of CA (US)

(73) Assignee: Chevron U.S.A. Inc., San Francisco, CA (US)

( * ) Notice: Subject to any disclaimer, the term of this patent is extended or adjusted under 35 U.S.C. 154(b) by 0 days.

(21) Appl. No.: 09/227,783

(22) Filed: Jan. 8, 1999

Related U.S. Application Data

(60) Provisional application No. 60/078,011, filed on Mar. 14, 1998.

(51) Int. Cl.[7] ..... C10G 65/12

(52) U.S. Cl. ..... 208/58; 208/97; 208/107; 208/142

(58) Field of Search ..... 208/89, 97, 58, 208/142, 107

(56) References Cited

U.S. PATENT DOCUMENTS

| | | | |
|---|---|---|---|
| 3,172,836 | 3/1965 | Robbers | 208/59 |
| 3,203,889 | 8/1965 | Pollitzer et al. | 208/57 |
| 3,256,178 | 6/1966 | Hass et al. | 208/89 |
| 3,328,290 | 6/1967 | Hengstebeck | 208/89 |
| 3,364,134 | 1/1968 | Hamblin | 208/93 |
| 3,475,322 | 10/1969 | Carson | 208/89 |
| 3,489,674 | 1/1970 | Borst, Jr. | 208/108 |
| 3,494,855 | 2/1970 | Stine et al. | 208/97 |
| 3,546,094 | 12/1970 | Jaffe | 208/59 |
| 3,728,249 | 4/1973 | Antezana et al. | 208/57 |
| 3,779,897 | 12/1973 | Wrench et al. | 208/89 |
| 3,847,799 | 11/1974 | Munro | 208/210 |
| 4,011,154 | 3/1977 | Stangeland et al. | 208/59 |
| 4,082,647 | 4/1978 | Hutchings et al. | 208/78 |
| 4,197,184 | 4/1980 | Munro et al. | 208/89 |
| 4,283,272 | 8/1981 | Garwood et al. | 208/59 |
| 4,615,789 | 10/1986 | Bridge et al. | 208/143 |
| 4,720,337 | 1/1988 | Graziani et al. | 208/58 |
| 5,009,768 | 4/1991 | Galiasso et al. | 208/89 |
| 5,114,562 | 5/1992 | Haun et al. | 208/89 |
| 5,290,427 | 3/1994 | Fletcher et al. | 208/89 |
| 5,382,349 | 1/1995 | Yoshita et al. | 208/49 |
| 5,403,469 | 4/1995 | Vank et al. | 208/78 |
| 5,522,983 | 6/1996 | Cash et al. | 208/59 |
| 5,603,824 | 2/1997 | Kyan et al. | 208/208 R |

FOREIGN PATENT DOCUMENTS

| | | |
|---|---|---|
| 787787A2 | 8/1997 | (EP) . |
| 1270607 | 8/1970 | (GB) . |
| WO97/38066 | 10/1997 | (WO) . |

*Primary Examiner*—Bekir L. Yildirim
(74) *Attorney, Agent, or Firm*—Alan W. Klaassen; Penny L. Prater

(57) ABSTRACT

A VGO stream is hydrocracking in a hydrocracking reaction zone within an integrated hydroconversion process. Effluent from the hydrocracking reaction zone is combined with a light aromatic-containing feed stream, and the blended stream hydrotreated in a hydrotreating reaction zone. The hydrocracked effluent serves as a heat sink for the hydrotreating reaction zone. The integrated reaction system provides a single hydrogen supply and recirculation system for use in two reaction systems.

22 Claims, 2 Drawing Sheets

HYDROCRACKING AND HYDROTREATING

This application claims priority from U.S. Provisional Application Ser. No. 60/078011, filed Mar. 14, 1998, the entire disclosure of which is incorporated herein be reference for all purposes.

BACKGROUND OF THE INVENTION

Much of refinery processing involves reaction of refinery streams in a hydrogen atmosphere. In order to maximize conversion efficiencies and to maintain catalyst life, excess hydrogen is generally used in the catalytic conversion processes, with the unreacted hydrogen being recovered, purified and repressurized for use as a recycle stream. Such recycle processes are costly, both in energy and in equipment. Some progress has been made in developing methods for using a single hydrogen loop in a two-stage reaction process. U.S. Pat. No. 5,009,768 teaches hydrodemetallizing a high-residual vacuum gas oil and hydroconverting the product from the first reaction zone at deep denitrogenation conditions in a second reaction zone. A cycle oil from an FCC may be added to the feed to the second reaction zone. U.S. Pat. No. 4,283,271 and U.S. Pat. No. 4,283,272 teach a processes for making lubricating oil which include passing a suitable hydrocarbon feed and hydrogen sequentially through a hydrocracking zone, a catalytic dewaxing zone and a hydrotreating zone, all at high pressure and in that order, with purification of the hydrogen gas prior to passage to the dewaxing zone. EP 787787 teaches hydroprocessing in parallel reactors, while hydrogen flows in series between the reactors.

U.S. Pat. No. 3,328,290 to Hengstebeck teaches combining the effluent from a hydrocracking zone with a hydrocarbon feedstock and passing the resultant combined stream through a feed-preparation zone.- A heavier liquid effluent, from the liquid effluent from the feed preparation zone, is passed, along with a separated hydrogen-containing gas, to the hydrocracking zone. Hengstebeck does not teach feeding a separate VGO stream to the hydrocracking zone.

Other methods have been proposed for separating partially reacted reactants within a reactor, removing one of the reacting streams (generally either a liquid or a vapor stream) and continuing reaction of the remaining stream. For example, U.S. Pat. No. 3,172,836 teaches a two-stage hydrocracking process, with denitrification being accomplished in the first conversion zone and cracking conversion being accomplished in the second conversion zone. In U.S. Pat. No. 3,172,836, a liquid-vapor separation zone is located between two catalyst beds for withdrawing a normally gaseous fraction and a normally liquid fraction from a first catalyst bed. The normally gaseous fraction, along with a second normally liquid fraction, is then passed downwardly through a second catalyst bed. The normally liquid fraction passed through the second catalyst bed may be a liquid fraction recovered from a distillation of the effluent from the first catalyst bed. In U.S. Pat. No. 4,615,789 a liquid/vapor separator is utilized between catalyst beds to remove liquid from between the beds and permit vapor separated by the separator to pass through catalyst beds below the separator.

U.S. Pat. No. 5,603,824 teaches a reactor having at least a top bed containing a hydrocracking catalyst and a bottom bed containing a dewaxing catalyst. A hydrocarbon feed mixture is separated, with the heavier stream being hydrocracked in the top bed of the reactor and the lighter stream combined with the effluent from the top bed and the combination catalytically dewaxed in the bottom bed.

However, additional developments are needed for hydroconverting dissimilar refinery streams using a single hydrogen source. The present invention is directed to such a process.

SUMMARY OF THE INVENTION

In one aspect, the invention provides a method for reducing the number of reactor vessels required for hydroprocessing in a refinery. In another aspect, the invention provides a method for hydroprocessing two refinery streams using a single hydrogen supply and a single hydrogen recovery system. In another aspect, the present invention provides a method for hydrocracking a refinery stream and hydrotreating a second refinery stream in a common reactor and with a common hydrogen feed supply without poisoning the feed to the hydrocracking reaction zone with contaminants present in the feed to the hydrotreating reaction zone. In another aspect, the present invention is directed to hydroprocessing two or more dissimilar refinery streams in an integrated hydroconversion process while maintaining good catalyst life and high yields of the desired products, particularly distillate range refinery products. Such dissimilar refinery streams may originate from different refinery processes, such as a VGO, derived from the effluent of a VGO hydrotreater, which contains relatively few catalyst contaminants and/or aromatics, and an FCC cycle oil or straight run diesel, which contains substantial amounts of aromatic compounds.

The integrated hydroconversion process comprises combining a first refinery stream with a first hydrogen-rich gaseous stream to form a first feedstock; passing the first feedstock to a first reaction zone maintained at conditions sufficient to effect a boiling range conversion, to form a first reaction zone effluent comprising normally liquid phase components and normally gaseous phase components; combining the entire first reaction zone effluent with a second refinery stream, having a boiling point range below the boiling point range of the first refinery stream, to form a second feedstock; passing the second feedstock to a second reaction zone maintained at conditions sufficient for converting at least a portion of the aromatics present in the second refinery stream, to form a second reaction zone effluent; separating the second reaction zone effluent into at least one distillate fraction and a second hydrogen-rich gaseous stream; and recycling at least a portion of the second hydrogen-rich gaseous stream to the first reaction zone.

A VGO is a preferred first refinery stream, and a synthetic or straight run middle distillate is a preferred second refinery stream. A suitable synthetic middle distillate, formed by cracking a heavier stock, may contain high nitrogen levels. The second refinery stream generally boils in the middle distillate boiling range, and is hydrotreated to remove nitrogen and/or aromatics, without excessive cracking. The preferred first reaction zone contains hydrocracking catalyst, maintained at hydrocracking conditions. Likewise, the preferred second reaction zone contains hydrotreating catalyst, maintained at hydrotreating reaction conditions. In the process, the first and the second reaction zones are contained within a single reactor vessel, or in two close coupled reactor vessels, with an single integrated hydrogen supply and recovery system serving both reaction zones. The process serves to prevent contaminants present in the second refinery stream from fouling the catalyst in the first reaction zone.

A preferred process comprises combining a VGO stream with a first hydrogen-rich gaseous stream to form a first feedstock; passing the first feedstock to a hydrocracking reaction zone, maintained at hydrocracking conditions sufficient to effect a boiling range conversion, to form a hydrocracking reaction zone effluent comprising normally liquid phase components and normally gaseous phase components; combining the entire hydrocracking reaction zone effluent, at substantially the same temperature and at substantially the same temperature as the hydrocracking reaction zone, with a second refinery stream, having a boiling point range below the boiling point range of the first refinery stream, to form a second feedstock; passing the second feedstock to a hydrotreating reaction zone, maintained at hydrotreating conditions sufficient for converting at least a portion of the nitrogen compounds and at least a portion of the aromatic compounds present in the residuum stream, to form a hydrotreating reaction zone effluent; separating the hydrotreating reaction zone effluent into at least a liquid stream and a second hydrogen-rich gaseous stream; separating the liquid stream to recover at least one middle distillate stream; and recycling at least a portion of the second hydrogen-rich gaseous stream to the hydrocracking reaction zone.

DETAILED DESCRIPTION OF THE INVENTION

Figure 1:
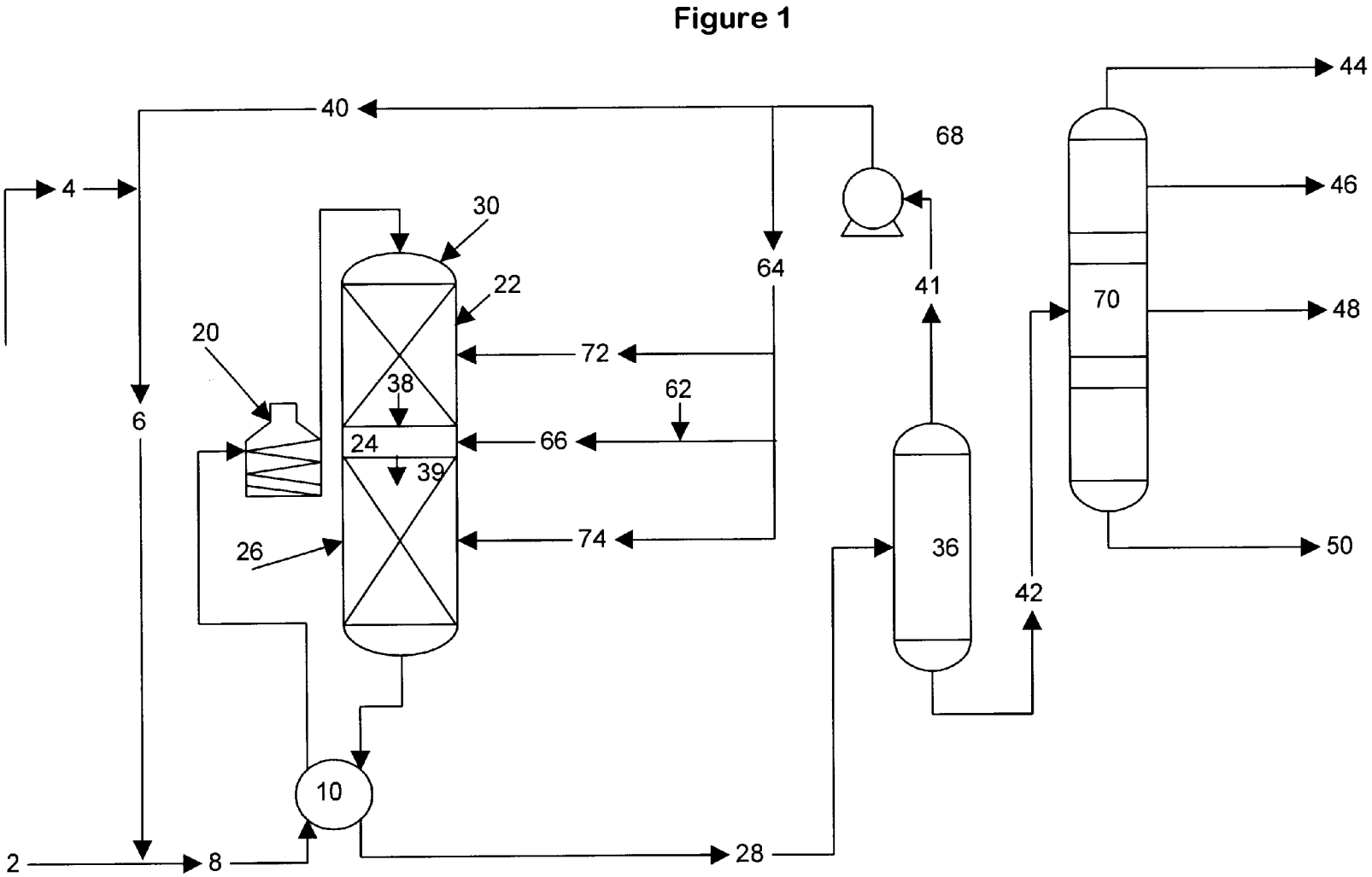
FIG. 1 illustrates an embodiment of the invention with a single reactor vessel containing a first reaction zone and a second reaction zone for the present integrated process.

This invention relates to two reaction processes, using two dissimilar feeds, which are combined into a single integrated reaction process, using a single hydrogen supply and recovery system. In the process, a heavier feed is hydrocracked to make a middle distillate and/or gasoline product, and a lighter feed is hydrotreated to upgrade the fuel properties of the lighter feed. The process is particularly useful for treating a second refinery stream which boils in a temperature range generally below that of the first refinery stream, or a feedstream which is to be treated to remove aromatics before being processed further.

In the process, a first refinery stream such as a VGO is hydrocracked in the presence of hydrogen over a hydrocracking catalyst contained in a first reaction zone at conditions sufficient to remove at least a portion of the nitrogen compounds from the first refinery stream and to effect a boiling range conversion. The entire effluent from the first reaction zone is then combined with a second refinery stream, and the combined feedstock, along with optional additional hydrogen-rich gas, is cascaded to a second catalyst bed in a second reaction zone, which is maintained at hydrotreating conditions sufficient to remove at least a portion of the aromatic compounds from the second refinery stream. The feedstocks may flow through one or both of the reaction zones in gravity flow in a downwardly direction or upwardly against gravity. The process is in contrast to a conventional practice of combining the second refinery stream with the first refinery stream and hydrocracking the combination together. Alternative conventional practice would treat the two feedstocks in separate processes, with separate hydrogen supply, recovery and recycle systems.

Contrary to conventional expectations, combining the effluent from the first reaction zone with the feed to the second reaction zone provides measurably higher selectivity from the integrated hydroconversion process of this invention. While conventional wisdom would argue against combining a hydrocracker effluent with a highly aromatic second refinery stream for hydrotreating, the present invention is based, among other factors, on the discovery that the present process produces increased amounts of a middle distillate product, at a lower hydrogen consumption, and higher catalytic activity than would have been observed had the first refinery stream and the second refinery stream been treated together as a mixture in a hydrocracking step followed by a hydrotreating step. The feeds and reaction conditions of the present process are selected to avoid cross contamination of any of the catalysts used in the processes or of the products prepared in the processes, while achieving the significant economic advantage of providing a single hydrogen supply, recycle and recovery system for the two reaction zones.

One suitable first refinery stream is a VGO having a boiling point range starting at a temperature above 500° F. (260° C.), usually within the temperature range of 500°–1100° F. (260°–593° C.). A refinery stream wherein 75 vol % of the refinery stream boils within the temperature range 650°–1050° F. is an example feedstock for the first reaction zone. The first refinery stream may contain nitrogen, usually present as organonitrogen compounds, in amounts greater than 1 ppm. Preferred feed streams for the first reaction zone contain less than about 200 ppm nitrogen and less than 0.25 wt % sulfur, though feeds with higher levels of nitrogen and sulfur, including those containing up to 0.5 wt % and higher nitrogen and up to 2 wt % sulfur and higher may be treated in the present process. The first refinery stream is also preferably a low aromatic stream, including multi-ring aromatics and asphaltenes. Suitable first refinery streams contain less than about 500 ppm asphaltenes, preferably less than about 200 ppm asphaltenes, and more preferably less than about 100 ppm asphaltenes. Example streams include light gas oil, heavy gas oil, straight run gas oil, deasphalted oil, and the like. The first refinery stream may have been processed, e.g. by hydrotreating, prior to the present process to reduce or substantially eliminate its heteroatom content. The first refinery stream may comprise recycle components.

The first reaction step removes nitrogen and sulfur from the first refinery stream in the first reaction zone and effects a boiling range conversion, so that the liquid portion of the first reaction zone effluent has a normal boiling range below the normal boiling point range of the first refinery feedstock. By "normal" is meant a boiling point or boiling range based on a distillation at one atmosphere pressure, such as that determined in a D1160 distillation. Unless otherwise specified, all distillation temperatures listed herein refer to normal boiling point and normal boiling range temperatures. The process in the first reaction zone may be controlled to a certain cracking conversion or to a desired product sulfur level or nitrogen level or both. Conversion is generally related to a reference temperature, such as, for example, the minimum boiling point temperature of the hydrocracker feedstock. The extent of conversion relates to the percentage of feed boiling above the reference temperature which is converted to products boiling below the reference temperature.

The first reaction zone effluent includes normally liquid phase components, e.g. reaction products and unreacted components of the first refinery stream, and normally gaseous phase components, e.g. gaseous reaction products and unreacted hydrogen. In the process, the first reaction zone is maintained at conditions sufficient to effect a boiling range conversion of the first refinery stream of at least about 25%, based on a 650° F. reference temperature. Thus, at least 25% by volume of the components in the first refinery stream which boil above about 650° F. are converted in the first reaction zone to components which boil below about 650° F. Operating at conversion levels as high as 100% is also within the scope of the invention. Example boiling range conversions are in the range of from about 30% to 90% or of from about 40% to 80%. The first reaction zone effluent is further decreased in nitrogen and sulfur content, with at least about 50% of the nitrogen containing molecules in the first refinery stream being converted in the first reaction zone. Preferably the normally liquid products present in the first reaction zone effluent contain less than about 1000 ppm sulfur and less than about 200 ppm nitrogen, more preferably less than about 250 ppm sulfur and about 100 ppm nitrogen.

Reaction conditions in the first reaction zone include a reaction temperature between about 250° C. and about 500° C. (482°–932° F.), pressures from about 3.5 MPa to about 24.2 MPa (500–3,500 psi), and a feed rate (vol oil/vol cat h) from about 0.1 to about 20 $hr^{-1}$. Hydrogen circulation rates are generally in the range from about 350 std liters $H_2$/kg oil to 1780 std liters $H_2$/kg oil (2,310–11,750 standard cubic feet per barrel). Preferred reaction temperatures range from about 340° C. to about 455° C. (644°–851° F.). Preferred total reaction pressures range from about 7.0 MPa to about 20.7 MPa (1,000–3,000 psi). With the preferred catalyst system, it has been found that preferred process conditions include contacting a petroleum feedstock with hydrogen under hydrocracking conditions comprising a pressure of about 13.8 MPa to about 20.7 MPa (2,000–3000 psi), a gas to oil ratio between about 379–909 std liters $H_2$/kg oil (2,500–6,000 scf/bbl), a LHSV of between about 0.5–1.5 $hr^{-1}$, and a temperature in the range of 360° C. to 427° C. (680°–800° F.).

The first and second reaction zones contain one or more catalysts. If more than one distinct catalyst is present in either of the reaction zones, they may either be blended or be present as distinct layers. Layered catalyst systems are taught, for example, in U.S. Pat. No. 4,990,243, the disclosure of which is incorporated herein by reference for all purposes. Hydrocracking catalysts useful for the first reaction zone are well known. In general, the hydrocracking catalyst comprises a cracking component and a hydrogenation component on an oxide support material or binder. The cracking component may include an amorphous cracking component and/or a zeolite, such as a Y-type zeolite, an ultrastable Y type zeolite, or a dealuminated zeolite. A suitable amorphous cracking component is silica-alumina.

The hydrogenation component of the catalyst particles is selected from those elements known to provide catalytic hydrogenation activity. At least one metal component selected from the Group VIII (IUPAC Notation) elements and/or from the Group VI (IUPAC Notation) elements are generally chosen. Group V elements include chromium, molybdenum and tungsten. Group VIII elements include iron, cobalt, nickel, ruthenium, rhodium, palladium, osmium, iridium and platinum. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten or one or more components of platinum and/or palladium. Catalysts containing nickel and molybdenum, nickel and tungsten, platinum and/or palladium are particularly preferred.

The hydrocracking catalyst particles of this invention may be prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined at temperatures up to 1200° F. (649° C.) to produce the finished catalyst particles. Alternative, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a hydrocracking catalyst.

The second refinery stream has a boiling point range generally lower than the first refinery stream. Indeed, it is a feature of the present process that a substantial portion of the second refinery stream has a normal boiling point in the middle distillate range, so that cracking to achieve boiling point reduction is not necessary. Thus, at least about 75 vol % of a suitable second refinery stream has a normal boiling point temperature of less than about 1000° F. A refinery stream with at least about 75% v/v of its components having a normal boiling point temperature within the range of 250°–700° F. in an example of a preferred second refinery stream. A refinery stream with at least about 75 vol % of its components having a normal boiling point temperature within the range of 250°–700° F. is another example of a preferred second refinery stream. The process is particularly suited for treating middle distillate streams which are not suitable for high quality fuels. For example, the process is suitable for treating a second refinery stream which contains high amounts of nitrogen and/or high amounts of aromatics, including streams which contain up to 90% aromatics and higher. Example second refinery streams which are suitable for treating in the present process include straight run vacuum gas oils, including straight run diesel fractions, from crude distillation, atmospheric tower bottoms, or synthetic cracked materials such as coker gas oil, light cycle oil or heavy cycle oil.

After the first refinery stream is treated in the first reaction zone, the first reaction zone effluent is combined with the second feedstock, and the combination passed together with hydrogen over the catalyst in the second reaction zone. Since the first reaction zone effluent is already relatively free of the contaminants to be removed in the second reaction zone, the first reaction zone effluent passes largely unchanged through the second reaction zone. And unreacted or incompletely reacted feed remaining in the effluent from the second reaction zone is effectively isolated from the first reaction zone to prevent contamination of the catalyst contained therein.

However, the presence of the first reaction zone effluent plays an important and unexpected economic -benefit in the integrated process. Leaving the first reaction zone, the effluent carries with it substantial thermal energy, which is passed to the second feedstock in the interstage region between the two reaction zones. This permits adding a cooler second feed stream to the integrated system than would otherwise be required, and saves on furnace capacity and heating costs.

As the second feedstock passes through the second reaction zone, the temperature again tends to increase due to exothermic reaction heating in the second zone. The first reaction zone effluent in the second feedstock serves as a heat sink, which moderates the temperature increase through the second reaction zone. The heat energy contained in the liquid reaction products leaving the second reaction zone is further available for exchange with other streams requiring heating. Generally, the outlet temperature of the second reactioizone will be higher than the outlet temperature of the first zone. In this case, the current invention will afford the added heat transfer advantage of elevating the temperature of the first reaction zone effluent for more effective heat transfer. The effluent from the first reaction zone also carries the unreacted hydrogen for use in the second reaction zone without any heating or pumping requirement to increase pressure.

The second reaction zone is maintained at conditions sufficient to remove at least a portion of the nitrogen compounds and at least a portion of the aromatic compounds from the second refinery stream. In the preferred embodiment, the first reaction zone and the second reaction zone are in liquid and vapor communication, and the pressure and the temperature in the second reaction zone are substantially the same as the pressure and the temperature in the first reaction zone. A small pressure decrease may occur, depending on the pressure drop across the reaction zones and through the interstage region. The second reaction zone will operate at approximately the same temperature as the first reaction zone, except for possible temperature gradients resulting from exothermic heating within the reaction zones, moderated by the addition of relatively cooler streams into the one or more reaction zones or into the interstage region. Feed rate of the reactant liquid stream through the reaction zones will be in the region of 0.1 to 20 $hr^{-1}$ liquid hourly space velocity. Feed rate through second reaction zone will be increased relative to the feed rate through first reaction zone by the amount of liquid feed in second refinery stream and will also be in the region of 0.1 to 20 $hr^{-1}$ liquid hourly space velocity. These process conditions selected for the first reaction zone may be considered to be more severe than those conditions normally selected for a hydrotreating process.

At any rate, hydrotreating conditions typically used in the second reaction zone will include a reaction temperature between about 250° C. and about 500° C. (482–932° F.), pressures from about 3.5 MPa to about 24.2 MPa (500–3, 500 psi), and a feed rate (vol oil/vol cat h) from about 0.1 to about 20 $hr^{-1}$. Hydrogen circulation rates are generally in the range from about 350 std liters $H_2$/kg oil to 1780 std liters $H_2$/kg oil (2,310–11,750 standard cubic feet per barrel). Preferred reaction temperatures range from about 340° C. to about 455° C. (644–851° F.). Preferred total reaction pressures range from about 7.0 MPa to about 20.7 MPa (1,000–3,000 psi).With the preferred catalyst system, it has been found that preferred process conditions include contacting a petroleum feedstock with hydrogen in the presence of the layered catalyst system under hydrocracking conditions comprising a pressure of about 16.0 MPa (2,300 psi), a gas to oil ratio at from about 379–909 std liters $H_2$/kg oil (2,500 scf/bbl to about 6,000 scf/bbl), a LHSV of between about 0.5–1.5 $hr^{-1}$, and a temperature in the range of 360° C. to 427° C. (680°–800° F.). Under these conditions, at least about 50% of the aromatics are removed from the second refinery stream in the second reaction zone. It is expected that as much as 30–70% or more of the nitrogen present in the second refinery stream would also be removed in the process. However, cracking conversion in the second reaction zone would be generally low, typically less than 20%. Standard methods for determining the aromatic content and the nitrogen content of refinery streams are available. These include ASTM D5291 for determining the nitrogen content of a stream containing more than about 1500 ppm nitrogen. ASTM D5762 may be used for determining the nitrogen content of a stream containing less than about 1500 ppm nitrogen ASTM D2007 may be used to determine the aromatic content of a refinery stream.

The second reaction zone contains hydrotreating catalyst, maintained at hydrotreating conditions. Catalysts known for hydrotreating are useful for the second reaction zone. Such hydrotreating catalysts are suitable for hydroconversion of feedstocks containing high amounts of sulfur, nitrogen and/or aromatic-containing molecules. It is a feature of the present invention that the hydrotreating step may be used to treat feedstocks containing asphaltenic contaminants which would otherwise adversely affect the catalytic performance or life of the hydrocracking reaction zone catalysts. The catalyst in the hydrotreating reaction zone are selected for removing these contaminants to low values. Such catalysts generally contain at least one metal component selected from Group VIII (IUPAC Notation) and/or at least one metal component selected from the Group VI (IUPAC notation) elements. Group VI elements include chromium, molybdenum and tungsten. Group VIII elements include iron, cobalt and nickel. While the noble metals, especially palladium and/or platinum, may be included, alone or in combination with other elements, in the hydrotreating catalyst, use of the noble metals as a hydrogenation component is not preferred. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten. Catalysts containing cobalt and molybdenum are particularly preferred.

The hydrotreating catalyst particles of this invention are suitably prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined at temperatures up to 1200° F. (649° C.) to produce the finished catalyst particles. Alternative, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a hydrotreating catalyst.

The subject process is especially useful in the production of middle distillate fractions boiling in the range of about 250°–700° F. (121°–371° C.) as determine by the appropriate ASTM test procedure. By a middle distillate fraction having a boiling range of about 250–700° F. is meant that at least 75 vol %, preferably 85 vol %, of the components of the middle distillate have a normal boiling point of greater than about 250° F. and furthermore that at least about 75 vol %, preferably 85 vol %, of the components of the middle distillate have a normal boiling point of less than 700° F. The term "middle distillate" is intended to include the diesel, jet fuel and kerosene boiling range fractions. The kerosene or jet fuel boiling point range is intended to refer to a temperature range of about 280°–525° F. (138°–274° C.) and the term "diesel boiling range" is intended to refer to hydrocarbon boiling points of about 250°–700° F. (121°–371° C.). Gasoline or naphtha is normally the $C_5$ to 400° F. (204° C.) endpoint fraction of available hydrocarbons. The boiling point ranges of the various product fractions recovered in any particular refinery will vary with such factors as the characteristics of the crude oil source, refinery local markets, product prices, etc. Reference is made to ASTM standards D-975 and D-3699-83 for further details on kerosene and diesel fuel properties.

Figure 2:
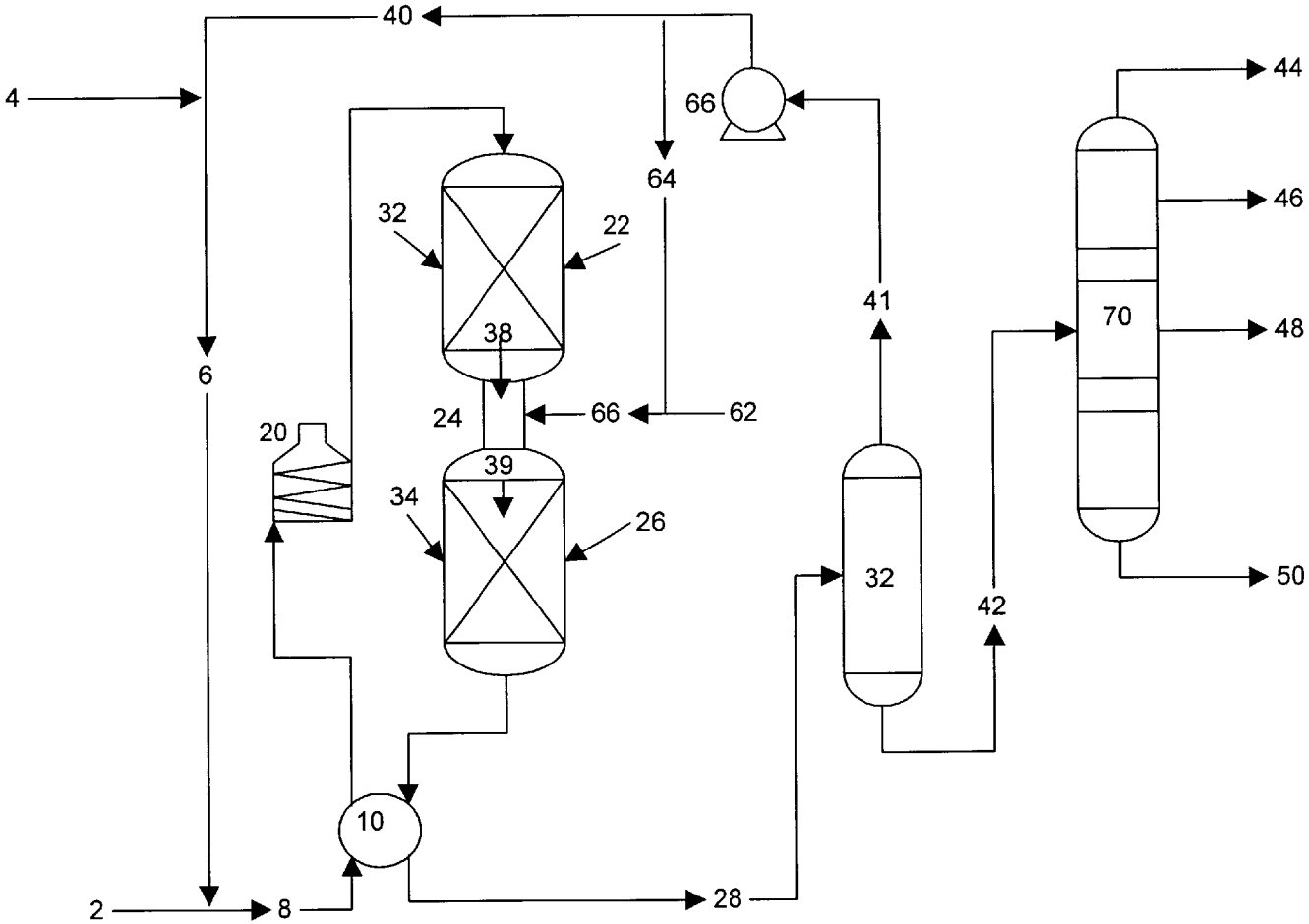
FIG. 2 illustrates a second embodiment having two reactor vessels, with a reaction zone contained in each vessel.

Reference is now made to FIGS. 1 and 2, which disclose preferred embodiments of the invention. Not included in the figures are the various pieces of auxiliary equipment such as heat exchangers, condensers, pumps and compressors, which, of course, would be necessary for a complete processing scheme and which would be known and used by those skilled in the art.

In FIG. 1, a single, downflow reactor vessel 30 contains at least two vertically aligned reaction zones. The first reaction zone 22 is for cracking a first refinery stream 2. The second reaction zone 26 is for removing nitrogen-containing and aromatic molecules from a second refinery stream 62. A suitable volumetric ratio of the catalyst volume in the first reaction zone to the catalyst volume in the second reaction zone encompasses a broad range, depending on the ratio of the first refinery stream to the second refinery stream. Typical ratios generally lie between 20:1 and 1:20. A preferred volumetric range is between 10:1 and 1:10. A more preferred volumetric ratio is between 5:1 and 1:2.

In the integrated process, a first refinery stream 2 is combined with a hydrogen-rich gaseous stream 6 to form a first feedstock 8, which is passed to first reaction zone 22 contained within reactor vessel 30. Hydrogen-rich gaseous stream 6 contains greater than 50% hydrogen, the remainder being varying amounts of light gases, including hydrocarbon gases. The hydrogen-rich gaseous stream 6 shown in the drawing is a blend of make-up hydrogen 4 and recycle hydrogen 40. While the use of a recycle hydrogen stream is generally preferred for economic reasons, it is not required. First feedstock 8 may be heated in one or more exchanges, such as exchanger 10, and one or more heaters, such as heater 20, before being introduced to first reaction zone 22.

Interstage region 24 is a region in the reactor vessel which contains means for mixing and redistributing liquids and gases from the reaction zone above before they are introduced into the reaction zone below. Such mixing and redistribution improves reaction efficiency and reduces the chances of thermal gradients or hot spots in the reaction zone below. Additional streams, including an additional hydrogen stream 64, may also be introduced into the reactor vessel in the interstage region. Hydrogen may also be added as a quench stream through lines 72 and 74 for cooling the first and the second reaction zones respectively. In the process, second refinery stream 62, is combined with optional hydrogen stream 64 forming combined feedstock 66, and is further combined with the total first reaction zone effluent 38 from the first reaction zone 22 to form second feedstock 39 for passage through the second reaction zone. In the embodiment shown in the drawing in FIG. 1, the combination of the two streams takes place in interstage region 24. Optional hydrogen stream 64 is shown originating as a portion of recycle hydrogen stream 40. Alternatively, optional hydrogen stream 64 may be a fresh hydrogen stream, originating from hydrogen sources external to the present process.

The second feedstock 39, comprising combined stream 66 and first reaction zone effluent 38, is passed to a second reaction zone 26. The second reaction zone 26 contains at least one bed of catalyst, such as hydrotreating catalyst, which is maintained at conditions sufficient for converting at least a portion of the nitrogen compounds and at least a portion of the aromatic compounds in the second feedstock.

Second reaction zone effluent 28 from the process contains thermal energy which may be recovered by heat exchange, such as heat exchanger 10. Second reaction zone effluent 28 is further separated into at least one distillate fraction and a second hydrogen-rich gaseous stream 41. Separation zone 36 represents one or more process units known in the art for separating normally liquid products from normally gaseous products in the reaction effluent 28, and thus preparing a liquid stream 42 and a purified hydrogen stream 41. An example separation scheme for a hydroconversion process is taught in U.S. Pat. No. 5,082,551, the entire disclosure of which is incorporated herein by reference for all purposes. In the example embodiment of FIG. 1, effluent 28 is separated in separation zone 36 to form second hydrogen-rich gaseous stream 41 and liquid stream 42. Separation zone 36 may include means for contacting a gaseous component of the reaction effluent 28 with a solution, such as an alkaline aqueous solution, for removing contaminants such as hydrogen sulfide and ammonia which may be generated in the reaction zones and may be present in reaction effluent 28. The second hydrogen-rich gaseous stream is preferably recovered from the separation zone at a temperature in the range of 100°–300° F., or 100°–200° F. Purified hydrogen stream 41, the second hydrogen-rich gaseous stream recovered from separation zone 36, is recompressed through compressor 68 and passed as recycle to one or more of the reaction zones and as a quench stream for cooling the reaction zones. Such uses of hydrogen are well known in the art.

Liquid stream 42 is further separated in distillation zone 70 to produce overhead stream 44, distillate fractions 46 and 48 and bottoms product 50. A preferred distillate product has a boiling point range within the temperature range 250°–700° F. A gasoline or naphtha fraction having a boiling point range within the temperature range $C_5$-400° F. is also desirable. At least a portion of one or more distillate fractions or bottoms fractions recovered from distillation zone 70 may be recycled to the first reaction zone or to the second reaction zone. Recycle of bottoms fraction 70 is preferred. It is a feature of the present invention that substantially none of the second refinery stream is recycled to the first reaction zone, in order to prevent overcracking of the second refinery stream components. Accordingly all of the converted second refinery stream present in the second reaction zone effluent is recovered as a distillate fraction for use elsewhere, most being recovered as either a light gas, naphtha or middle distillate fuel.

The drawing in FIG. 1 shows a single, downflow reactor having at least two vertically aligned reaction zones, 22 and 26, each containing at least one catalyst bed. One or more additional reaction zones upstream of the first reaction zone, and one or more additional reaction zones downstream of the second reaction zone, may also be present in the reactor vessel or in accompanying reactor vessels. As used herein, the relative positions "upstream" and "downstream" are related to a reference position by the direction of liquid flow through the reactor vessel. Employing a single reactor vessel in the present process is preferred for economic reasons. However, depending on the particular application of the present process, the required total catalyst volume may be excessive for a single reactor vessel, and two or more vessels may be called for, as in the drawing in FIG. 2. If first reaction zone 22 contains at least one catalyst bed and resides in a first reactor vessel 32, and second reaction zone 26 contains at least one catalyst bed and resides in a second reactor vessel 34, it is understood that the two reactor vessels would be in liquid and vapor communication with each other via interstage region 24, and that the entire effluent from the first reactor vessel would flow into the second reaction zone in the second reactor vessel. The second refinery stream 62, along with optional added hydrogen 64, may be introduced anywhere along the length of the reactor vessels, or between reactors.

The embodiments illustrated in FIGS. 1 and 2 show the hydrocracking reaction zone contained within a single reactor vessel, and the hydrotreating reaction zone contained within a single reactor vessel. It will be obvious to those skilled in the art that the volume of catalyst required for a particular process of the invention may be too great to be contained economically within one reactor vessel. For example, the process may be suitably practiced with a hydrocracking reaction zone contained in more than one reactor vessel. Likewise, the process may be suitably practiced with a hydrotreating reaction zone contained in more than one reactor vessel. When multiple reactor vessels are used for one or both of the reaction zones, the interstage region in which the residuum feedstock is passed to the hydrotreating reaction zone may be within a reactor vessel, as in FIG. 1, or between reactor vessels, as in FIG. 2.

EXAMPLES OF THE INVENTION

A reactor system was prepared containing 65 vol % Catalyst I over 36 vol % Catalyst II (see Table I) A heavy VGO (Feed A in Table II) was contacted with 5000 SCF/Bbl hydrogen over Catalyst I. A light cycle oil (Feed B in Table II) at approximately the same volumetric flow rate was contacted, along with the effluent from Catalyst I over Catalyst II. Conditions and results are tabulated in Table III.

TABLE I

| | Composition | Vol % in reactor |
|---|---|---|
| Catalyst I | 4% Ni/20% W/20% USY | 64 |
| Catalyst II | 3% Ni/21% Mo/3% P | 36 |

TABLE II

| | Heavy VGO (Feed A) | Light Cycle Oil (Feed B) | Mixed Feed (Feed C): 51.5 wt % Feed A + 48.5 wt % Feed B |
|---|---|---|---|
| API Gravity | 21.3 | 16.3 | 19.1 |
| Nitrogen, ppm | 716 | 1014 | 909 |
| Sulfur, Wt % | 2.93 | 0.59 | 1.72 |
| Composition | | | |
| Paraffins | 19.0 | | 12.6 |
| Naphthenes | 25.4 | | 21.2 |
| Paraffins/ Naphthenes | | 15.1 | |
| Aromatics | 55.6 | 81.4 | 66.2 |
| Olefins | | 3.5 | |
| Simulated Distillations (D 2887) | ° F. | ° F. | |
| 0.5/5 | 536/671 | 224/389 | 261/433 |
| 10/30 | 710/786 | 437/502 | 472/579 |
| 50 | 834 | 562 | 701 |
| 70/90 | 878/937 | 626/706 | 808/899 |
| 95/99.5 | 967/1031 | 736/795 | 934/1003 |

Comparative Example

In a comparative example, the quantities of Feed A and Feed B from the examples above were combined in a mixture, and the mixture contacted with 5000 SCFB hydrogen over Catalyst A at the rate of addition used in Example 1. Effluent from Catalyst A were then introduced to Catalyst B. Conditions and results are tabulated in Table III.

As shown by the data, the cracking activity, as measured by the conversion of 680° F.+ components in the feed to 680° F.− components in the product, was surprisingly higher in the process of the invention than in the conventional comparative case. Even more surprising is the significantly reduced hydrogen consumption in the process of the invention, and the increased middle distillate selectivity, where middle distillate selectivity is the volumentric ratio of products boiling in the 338°–680° F. range to the products boiling in the 149°–338° F. range.

TABLE III

| Reactor 1 | | | Reactor 2 | | | | Hydrogen | Middle |
|---|---|---|---|---|---|---|---|---|
| Feed | Temp, ° F. | Pressure | Feed | Temp, ° F. | Pressure | Conversion <680° F. | consumption, SCF/Bbl | Distillate Selectivity |
| Feed A | 745 | 2300 | Effluent from Reactor 1 + | 675 | 2300 | 78 | 1440 | 5.7 |
| Feed A | 745 | 2300 | Feed B | 660 | 2300 | 78 | 1337 | 5.2 |
| Feed A | 745 | 2300 | | 710 | 2300 | 79 | 1624 | 4.8 |
| Feed C | 745 | 2300 | Effluent from Reactor 1 | 710 | 2300 | 63 | | |
| Feed C | 755 | 2300 | | 720 | 2300 | 67 | | |
| Feed C | 775 | 2300 | | 740 | 2300 | 75 | 1943 | 3.8 |

What is claimed is:

1. An integrated hydroconversion process comprising:

a) combining a first refinery stream with a first hydrogen-rich gaseous stream to form a first feedstock;

b) passing the first feedstock to a first reaction zone maintained at conditions sufficient to effect a boiling range conversion of the first refinery stream of at least about 25%, to form a first reaction zone effluent comprising normally liquid phase components and normally gaseous phase components;

c) combining the entire first reaction zone effluent, to form a second feedstock;

d) passing the second feedstock to a second reaction zone maintained at conditions sufficient for converting at least a portion of the aromatics present in the second refinery stream, to form a second reaction zone effluent;

e) separating the second reaction zone effluent into at least one distillate fraction and a second hydrogen-rich gaseous stream; and f) recycling at least a portion of the second hydrogen-rich gaseous stream to the first reaction zone.

2. The process according to claim 1 wherein the first reaction zone is maintained at conditions sufficient to effect a boiling range conversion of between 30% and 90%.

3. The process according to claim 1 wherein the first refinery stream has a normal boiling point range within the temperature range 500°–1100° F. (262°–593° C.).

4. The process according to claim 1 wherein the first refinery stream is derived from a hydrotreating process.

5. The process according to claim 1 wherein the first refinery stream is a VGO.

6. The process according to claim 1 wherein at least about 80% by volume of the second refinery stream boils at a temperature of less than about 1000° F.

7. The process according to claim 6 wherein at least about 50% by volume of the second refinery stream has a normal boiling point within the middle distillate range.

8. The process according to claim 7 wherein at least about 80% by volume of the second refinery stream boils with the temperature range of 250°–700° F.

9. The process according to claim 1 wherein the second refinery stream is a synthetic cracked stock.

10. The process according to claim 1 wherein the second refinery stream is selected from the group consisting of straight run VGO, light cycle oil, heavy cycle oil and coker gas oil.

11. The process according to claim 1 wherein the second refinery stream has an aromatics content of greater than about 50%.

12. The process according to claim 11 wherein the second refinery stream has an aromatics content of greater than about 70%.

13. The process according to claim 1 wherein the first reaction zone is maintained at hydrocracking reaction conditions, including a reaction temperature in the range of from about 340° C. to about 455° C. (644°–851° F.), a reaction pressure in the range of about 3.5–24.2 MPa (500–3500 pounds per square inch), a feed rate (vol oil/vol cat h) from about 0.1 to about 10 $hr^{-1}$ and a hydrogen circulation rate ranging from about 350 std liters $H_2$/kg oil to 1780 std liters $H_2$/kg oil (2,310–11,750 standard cubic feet per barrel).

14. The process according to claim 13 wherein the entire first reaction zone effluent is passed to the second reaction zone at substantially the same temperature and at substantially the same pressure as the first reaction zone.

15. The process according to claim 13 wherein the second reaction zone is maintained at a temperature and at a pressure which are substantially the same as the temperature and the pressure maintained in the first reaction zone.

16. The process according to claim 1 wherein the second reaction zone effluent is separated in a separation zone to form at least a second hydrogen-rich gaseous stream and a liquid stream.

17. The process according to claim 16 wherein the second hydrogen-rich gaseous stream is recovered from the separation zone at a temperature in the range of 100°–300° F.

18. The process according to claim 16 wherein the liquid stream is fractionated to form at least one middle distillate stream and a bottoms product.

19. The process according to claim 18 for producing at least one middle distillate stream having a boiling range within the temperature range 250°–700° F.

20. The process according to claim 1 for producing a diesel fuel.

21. The process according to claim 1 for producing a jet fuel.

22. The process according to claim 1 wherein the distillate fraction recovered from the hydrotreater reaction zone effluent further comprises components boiling in the range $C_5$-400° F.

* * * * *